US007204724B2

(12) United States Patent
Holtz

(10) Patent No.: US 7,204,724 B2
(45) Date of Patent: Apr. 17, 2007

(54) PLASTIC FLANGE WITH MOLDED-OVER HARNESS

(75) Inventor: Raymond Holtz, Auburn Hills, MI (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 11/363,943

(22) Filed: Mar. 1, 2006

(65) Prior Publication Data

US 2006/0199440 A1 Sep. 7, 2006

Related U.S. Application Data

(60) Provisional application No. 60/658,756, filed on Mar. 4, 2005.

(51) Int. Cl.
*H01R 9/22* (2006.01)

(52) U.S. Cl. ..... 439/722; 439/736; 417/422

(58) Field of Classification Search ..... 439/736, 439/722; 417/422
See application file for complete search history.

(56) References Cited

U.S. PATENT DOCUMENTS

| | | | | |
|---|---|---|---|---|
| 3,825,669 | A | 7/1974 | Korner et al. | |
| 4,213,004 | A | 7/1980 | Acker et al. | |
| 4,289,924 | A | 9/1981 | Pearce, Jr. et al. | |
| 4,599,487 | A | 7/1986 | Blank et al. | |
| 4,822,294 | A | 4/1989 | McClearn | |
| 4,961,018 | A | 10/1990 | Akhter | |
| 5,038,741 | A | 8/1991 | Tuckey | |
| 5,170,017 | A | 12/1992 | Stanevich et al. | |
| 5,207,562 | A * | 5/1993 | Neibrook et al. | 417/234 |
| 5,613,844 | A | 3/1997 | Tuckey et al. | |
| 5,631,445 | A | 5/1997 | Herster | |
| 5,669,763 | A * | 9/1997 | Pryce et al. | 417/313 |
| 6,213,101 | B1 | 4/2001 | Numbers et al. | |
| 6,231,318 | B1 | 5/2001 | Cotton et al. | |
| 6,422,839 | B1 | 7/2002 | Brockner et al. | |
| 6,501,025 | B2 | 12/2002 | Tilli et al. | |
| 6,555,754 | B2 | 4/2003 | Gilmour | |
| 6,644,289 | B2 | 11/2003 | Noda | |
| 6,966,800 | B2 * | 11/2005 | Mott | 439/722 |

FOREIGN PATENT DOCUMENTS

| | | |
|---|---|---|
| GB | 2207079 A | 1/1989 |
| JP | 11167960 | 6/1999 |
| JP | 2001271718 | 10/2001 |
| JP | 2003193926 | 7/2003 |

* cited by examiner

*Primary Examiner*—Michael C. Zarroli

(57) ABSTRACT

A method provides wiring associated with a flange of a fuel delivery module for use in a fuel tank of a vehicle. The method includes molding a plastic flange 12 of a fuel delivery module, with the flange defining an inside region 11 and an outside region 7. At least one terminal 20' is provided that is accessible from the outside region of the flange. An electrical connection 28 is established between the at least one terminal and a wire 16'. In one embodiment, plastic material 25 is molded directly over a) the connection 28, b) at least a portion 32 of the wire 16' and c) at least a portion 34 of the terminal 20' to seal the connection, the portion of the wire, and the portion of the terminal between the inside region and outside region of the flange. In another embodiment a pre-formed plastic body encapsulates the connection 28 and the body is placed in a flange mold and plastic material is over molded to encapsulate the portion of the terminal while molding the flange.

10 Claims, 5 Drawing Sheets

PLASTIC FLANGE WITH MOLDED-OVER HARNESS

This application is based on U.S. provisional Application No. 60/658,756, filed on Mar. 4, 2005 and claims the benefit thereof for priority purposes.

FIELD OF THE INVENTION

The invention relates to fuel delivery modules for use in a vehicle fuel tank and, more particularly, to a plastic flange of a module having a molded-over wire harness.

BACKGROUND OF THE INVENTION

Current solutions for routing electrical lines though a flange of a fuel delivery module in a fuel tank for automotives are: 1) over-molded terminals with a connector on the inside and outside (sealed or unsealed), 2) over-molded terminals with a connector outside and soldered wires on the inside, 3) drop-in electrical connector (separate assembly sealed to the flange with an O-ring and clipped into the flange), 4) over-molded pre-mold (terminals with wire harness are molded over in a pre-mold assembly).

In a Flex Fuel application (E85 fuel with high methanol content), a sealed electrical connection must be provided both inside and outside of the flange. Employing the above-mentioned solutions for Flex Fuel applications is expensive (e.g., requiring sealed connector(s)), results in high permeation rates, and requires significant packaging space. For example, employing an overmolded pre-mold assembly can result in leakage between the pre-mold and the flange and/or between the terminal(s) and the pre-mold.

Thus, there is a need to reduce the cost of sealing a wire harness with respect to a flange of a fuel module, to reduce permeability rates, and to reduce packaging size/space.

SUMMARY OF THE INVENTION

An object of the present invention is to fulfill the need referred to above. In accordance with the principles of the present invention, this objective is obtained by a method of providing wiring associated with a flange of a fuel delivery module for use in a fuel tank of a vehicle. The method includes molding a plastic flange of a fuel delivery module, with the flange defining an inside region and an outside region. At least one terminal is provided that is accessible from the outside region of the flange. An electrical connection is established between the at least one terminal and a wire. Plastic material is molded directly over a) the connection between the at least one terminal and wire, b) at least a portion of the wire, and c) at least a portion of the terminal to seal the connection, the portion of the wire, and the portion of the terminal between the inside region and outside region of the flange, with an end of the wire being accessible from the inside region of the flange.

In accordance with another aspect of the invention, a method provides a wiring harness assembly associated with a flange of a fuel delivery module for use in a fuel tank of a vehicle. The method provides a wire harness assembly including at least one terminal joined with at least one wire via an electrical connection, with the electrical connection being encapsulated and sealed in plastic material of a body. At least a portion of the wiring harness is inserted into a mold. Plastic material is molded, together with the portion of the wire harness assembly, to create a flange of a fuel delivery module. The flange defines an inside region and an outside region. The terminal is accessible from the outside region of the flange, with an end of the wire being accessible from the inside region of the flange. The molding step includes molding the plastic material directly over at least a portion of the terminal to encapsulate the portion of the terminal in the plastic material.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
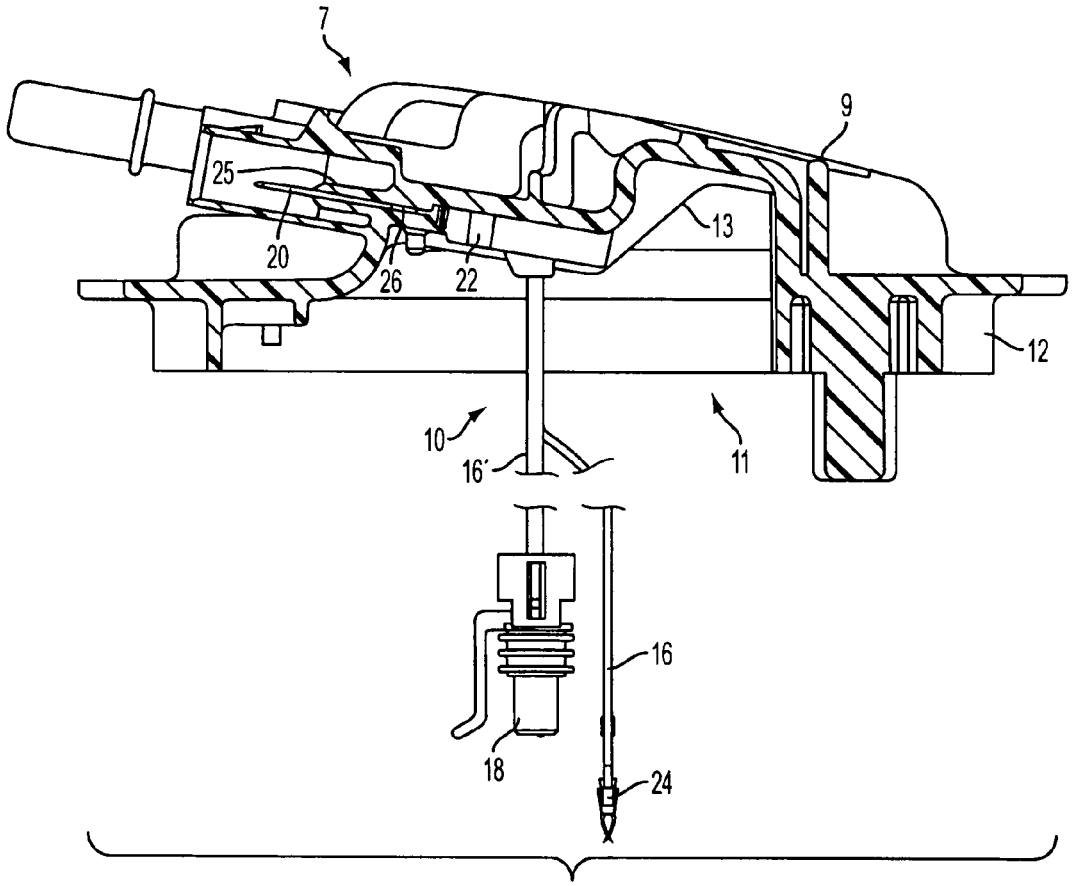
FIG. 1 is a sectional view of a flange of a fuel delivery module having an over-molded wire harness assembly provided in accordance with principles of the present invention.

The embodiments aim at reducing the costs of sealing a wire harness assembly of flange of a fuel delivery module and at reducing packaging space required for electrical connections. With reference to FIG. 1, in accordance with an embodiment of the invention, a wire harness assembly is shown, generally indicated at 10, mounted with respect to a plastic flange 12. The flange 12 is used in a conventional fuel module that is constructed and arranged to be mounted in a fuel tank of a vehicle. The embodiment also aims at reducing permeation rates with regard to the wire harness, particularly when E85 fuel is employed. The flange 12 is constructed and arranged to seal an opening in a fuel tank of a vehicle. The flange 12 defines an outside region, generally indicated at 7, via outside surface 9, and an inside region generally indicated at 11, via an inside surface 13.

Figure 2:
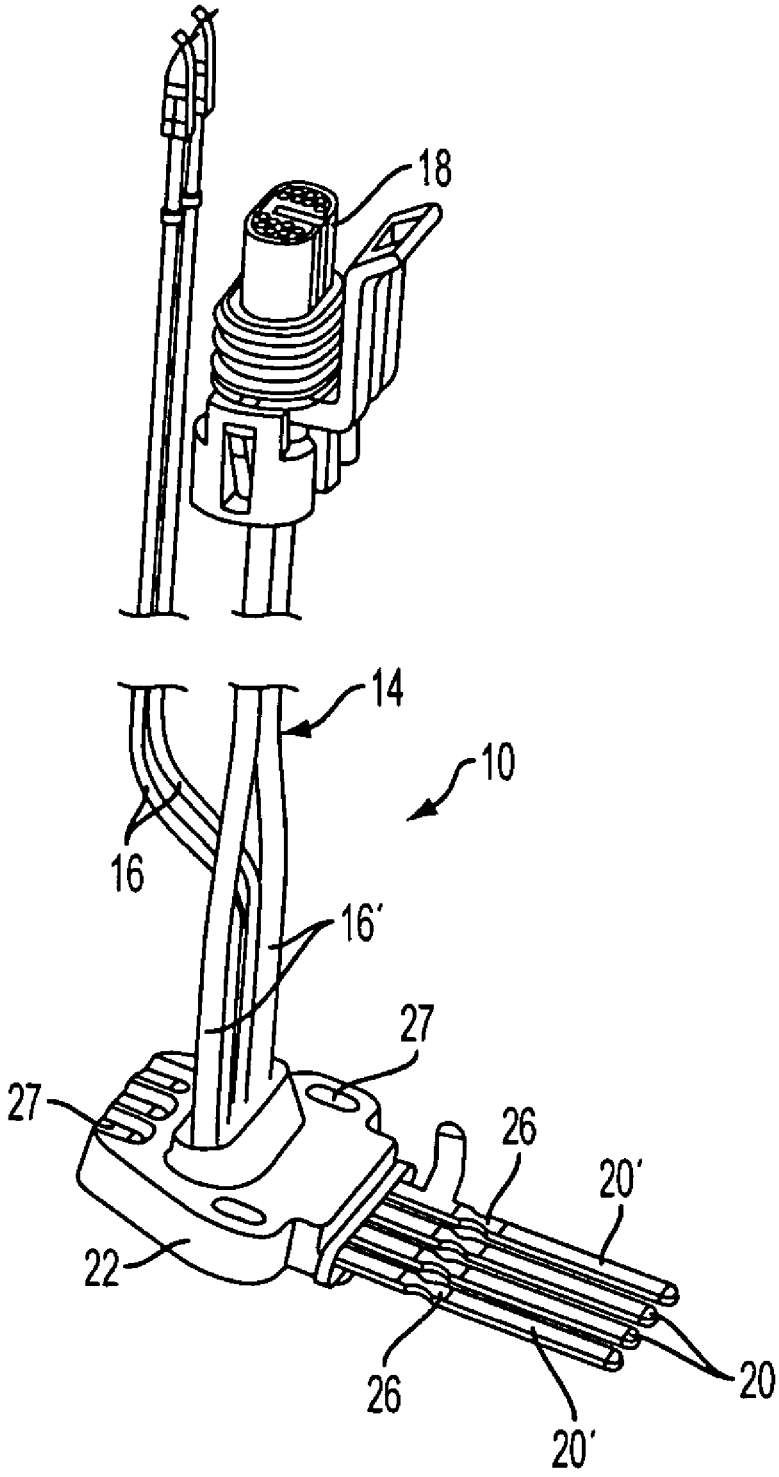
FIG. 2 is a perspective view of the wire harness assembly of FIG. 1.

FIG. 2 shows an embodiment of the wire harness assembly 10. The assembly 10 includes a wire harness, generally indicated at 14, having two wires 16 for powering a level sender and two wires 16' provided for powering a fuel pump via connector 18. Ends of the wires 16 are preferably crimped to an associated terminal 20. Also, ends of wires 16' are preferably crimped to terminals 20'. Other means for electrically connecting the ends of the wires 16, 16' to the associated terminals 20, 20' can be used such as soldering, or other mechanical or chemical connections. A plastic body 22 is molded over the connection (e.g., crimped connection 28 of FIG. 3) between the wires 16, 16' and the associated terminals 20, 20' thereby eliminating the need for a sealed connector and thus reducing packaging space. The terminals 20, 20' are constructed and arranged to be connected to a power source located outside of a fuel tank. The connector 18 and ends 24 of the wires 16 are available inside of the fuel tank for powering components noted above. Although four wires and terminal pairs are shown, fewer or more than four pairs can be provided.

Returning to FIG. 1, the harness assembly 10 is placed in the flange tool and plastic material 25 (such as, for example acetel thermoplastic resin) of the flange 12 is directly over molded onto a portion of the terminals 20, 20'. This ensures that a barrier to the outside of the fuel tank is created, preventing permeation and liquid leakage. As shown in FIG. 2, each terminal 20, 20' includes a surface feature 26 that aids in creating a robust connection of the terminals 20, 20' with the over molded plastic of the flange 12.

As noted above in the Background section, in conventional over-molding, a pre-mold may create additional leakage since there is a leakage path between the terminals and the pre-mold material plus a leakage path between the pre-mold and the flange. Since, in conventional over-molding, there is no chemical connection between the pre-mold and the flange (even when choosing the same plastic material) only shrinkage of the flange plastic will create a press fit seal (as it does between the terminals and the plastic). The plastic body 22 and over molded terminals eliminate these issues.

With reference to FIG. 2, the plastic body 22 includes structure 27 that holds the harness assembly 10 to the flange 12. If a crash of a vehicle employing the flange 12 were to occur, with plastic body 22 of the harness assembly 10 will in the worst case, separate from the flange 12, and/or the wires will break before the body separates from the flange. The over-molded material 25 will prevent a leak path from the inside region 11 to the outside region 7 from being created. The peeling off of the body 22 from the flange 12 will reduce crash energy and will bend the terminals 20, 20', but will not pull them out of the flange 12.

Figure 3:
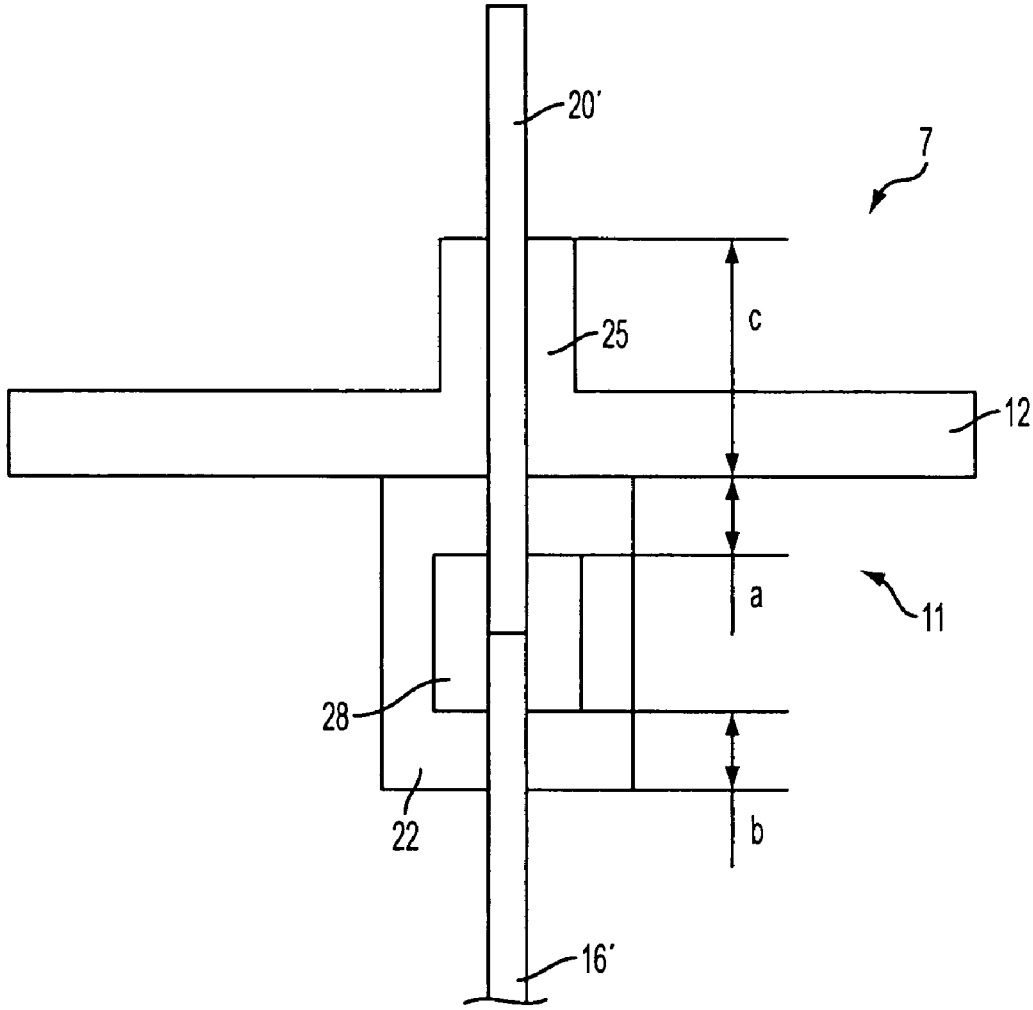
FIG. 3 is schematic illustration of a wire, terminal, connection there-between, pre-mold body, and flange of FIG. 1.

FIG. 3 is schematic illustration of a wire 16', terminal 20', connection 28 there-between, the pre-mold body 22, and flange 12 of FIG. 1. As shown, (a) is the length that the terminal 20' is covered by the body 22, (b) is the length that the wire 16' is covered by the body 22 and (c) is the length that the terminal 20' is covered by plastic material 25 of the flange 12.

Figure 4:
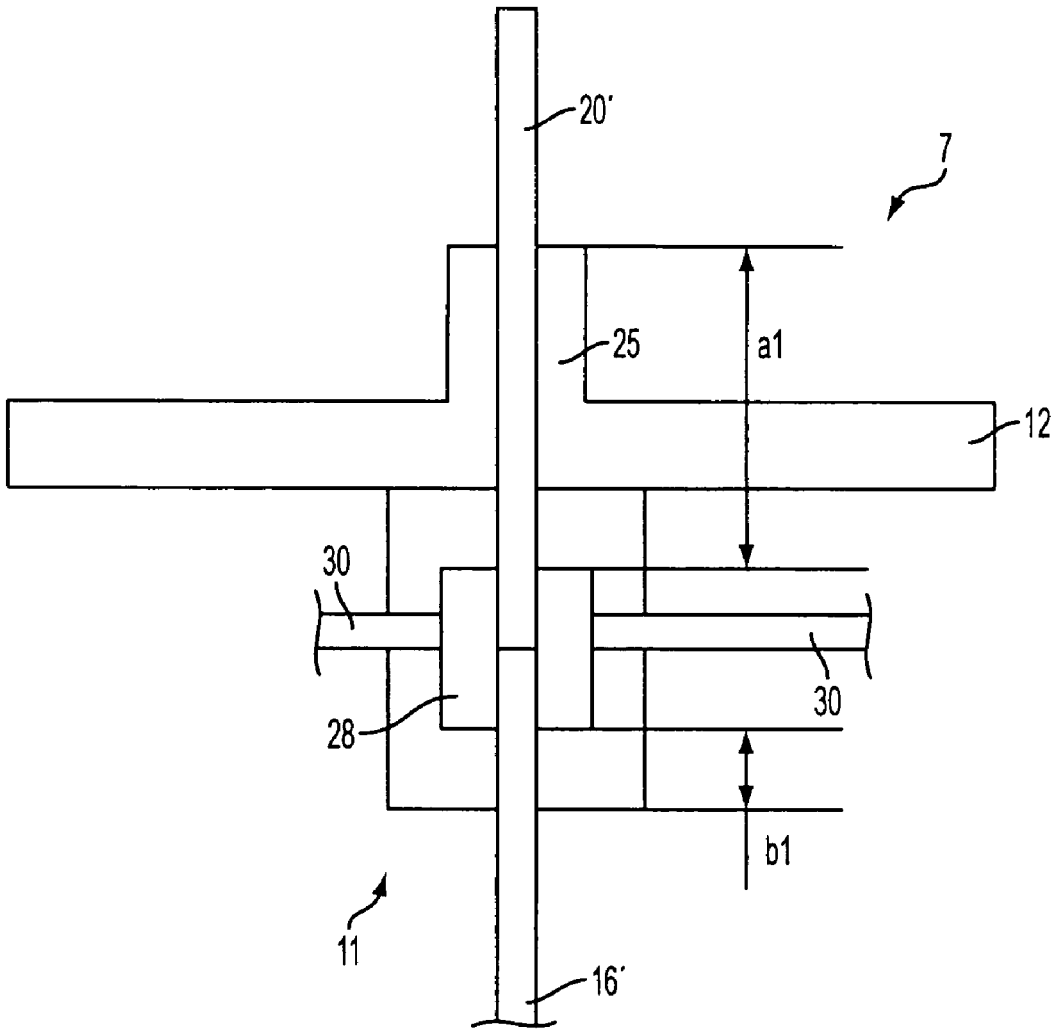
FIG. 4 is schematic illustration of a wire, terminal, connection there-between, holding structure, and flange in accordance with another embodiment of the invention.

FIG. 4 is a schematic illustration of a terminal 20' and a wire 16' of a wire harness assembly in accordance with another embodiment of the invention. In FIG. 4, one terminal 20' is shown electrically connected to an associated wire 16' via a connection 28. The other terminals 20, 20' and associated wires 16, 16' are substantially identical and are not shown in FIG. 4. The connection 28 can be, for example, soldering, crimping, or by other mechanical or chemical processes. In the embodiment of FIG. 4, the terminal 20' with attached wire is held in place with an optional holding structure 30, such as retractable pins, while over-molding plastic material 25 of the flange 12. The additional holding structure 30 simply holds components and does not seal components. If retractable pins are used as the holding structure, the pins are moved away from a holding position after preset time during the molding process, thus ensuring that plastic material flows all around the connection 28 without leaving openings of any kind. In other embodiments, the holding structure 30 can be directly over-molded with plastic material 25, along with portions 32 of the wire 16' and portion 34 of the terminal 20' of the harness assembly 10'. No part of the wiring harness assembly 10' protrudes through the top surface of the flange 12.

With reference to FIG. 4, an advantage of the embodiment, as compared to conventional methods, is that a portion of the terminal 20' is over-molded or encapsulated in plastic with the appropriate length (a1) and an associated portion of the wire 16' is over-molded or encapsulated in the plastic 25 with the approximate length (b1) directly in the flange tool to ensure a minimal leakage and reduce cost due to fewer parts and less manufacturing steps (as compared to FIG. 3). Preferably, the minimum dimension (a1) is 8 mm as measured from a joining point of the terminal 20' and the connection 28, and the minimum dimension (b1) is 5–6 mm as measured from a joining point of the wire 16' with the connection 28. The connection 28 is also encapsulated in plastic.

Figure 5:
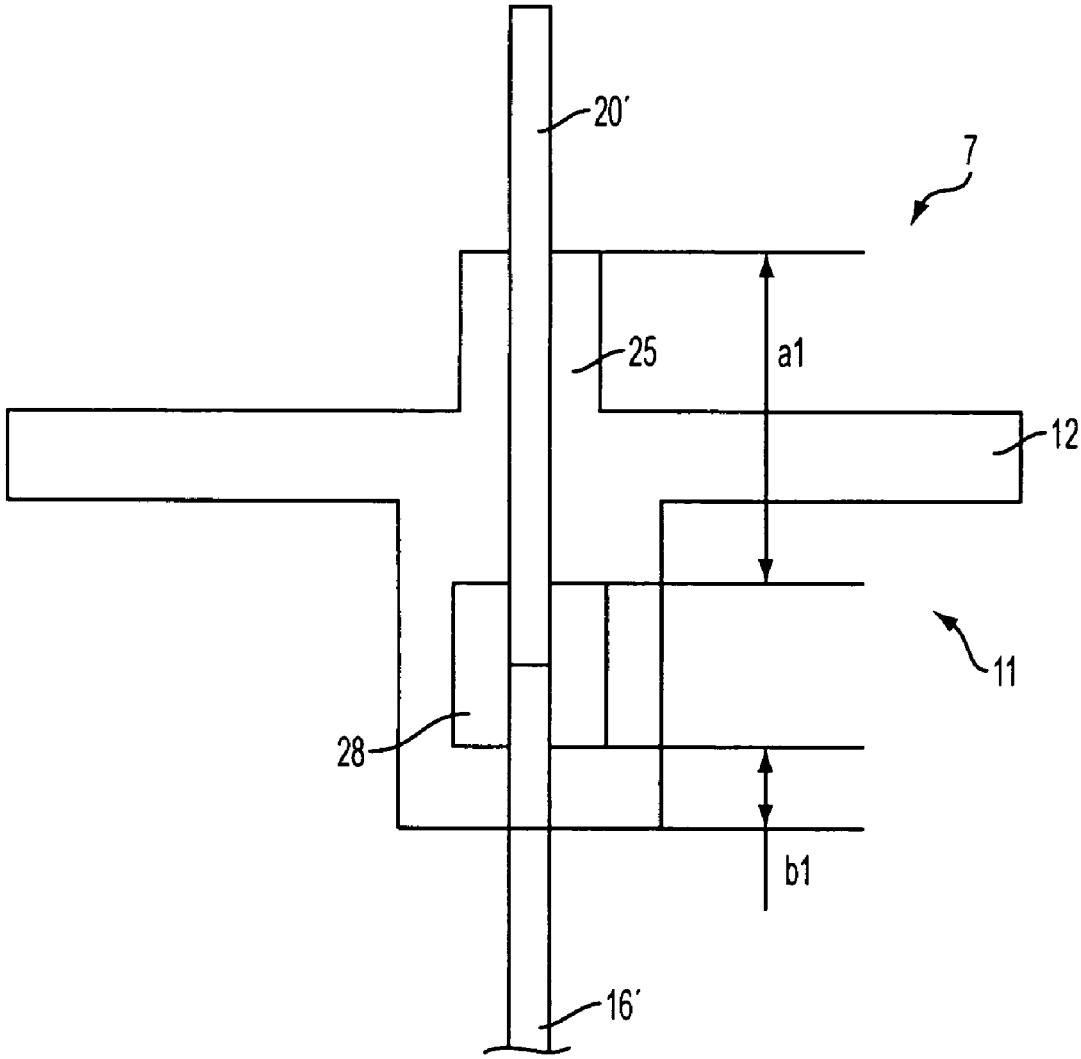
FIG. 5 is schematic illustration of a wire, terminal, connection there-between, and flange in accordance with yet another embodiment of the invention.

FIG. 5 is a schematic illustration of a terminal 20' and a wire 16' of a wire harness assembly in accordance with yet another embodiment of the invention. In FIG. 5, one terminal 20' is shown electrically connected to an associated wire 16' via a connection 28. The other terminals 20, 20' and associated wires 16, 16' are substantially identical and are not shown in FIG. 5. The embodiment of FIG. 5 is identical to that of FIG. 4, but no additional holding structure 30 is used in FIG. 5. Thus, cost is reduced as compared to the embodiment of FIG. 4. Length (a1) is the length that the terminal 20' is covered by material 25 of the flange 12 and length (b1) is the length that the wire 16' is covered by the material 25 of the flange.

In accordance with the embodiments of FIGS. 4 and 5, all terminals 20, 20' are over-molded directly with dimension (a1) during molding of the flange 12 while holding the terminals with the wiring harness directly (no additional parts such as connectors as in FIG. 5) or indirectly (using additional structure 30 to aid the manufacturing process as in FIG. 4). An important aspect of these embodiments is to over-mold plastic material 25 directly and thus seal the terminal(s) 20', the connection(s) 28 between terminal(s) 20' and wire(s) 16' (mechanically or chemically connected) and a specified length (b1) of the wire 16'. The over-molding of the terminals 20', the connection 28, and portions of wire 16' is preferably performed substantially at the same time as the flange 12 is molded.

Thus, over-molding the terminals 20, 20' with plastic material 25 can be achieved by: a) using a pre-mold body 22 to encapsulate the connection between the terminals 20, 20' and the wires 16, 16' and mold-over the terminals 20, 20' into the flange 12 (FIGS. 1 and 3), b) holding the terminals 20, 20' with attached wires 16, 16' in place with additional holding structure 30 (FIG. 4) while over-molding with the additional holding structure 30 simply holding and not sealing components, and c) molding over terminals 20, 20' with attached wires 16, 16' without any additional holding structure (FIG. 5).

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of providing wiring associated with a flange of a fuel delivery module for use in a fuel tank of a vehicle, the method including:

molding a plastic flange of a fuel delivery module, the flange defining an inside region and an outside region, providing at least one terminal accessible from the outside region of the flange, establishing an electrical connection between the at least one terminal and a wire, molding plastic material directly over a) the connection, b) at least a portion of the wire, and c) at least a portion of the terminal to seal the connection, the portion of the wire, and the portion of the terminal between the inside region and outside region of the flange, with an end of the wire being accessible from the inside region of the flange, and further including the step of holding the terminal, the connection and the wire without sealing during the molding plastic material step.

2. A method of providing a wiring harness assembly associated with a flange of a fuel delivery module for use in a fuel tank of a vehicle, the method including:

providing a wire harness assembly including at least one terminal joined with at least one wire via an electrical connection, with the electrical connection being encapsulated and sealed in plastic material of a body, inserting at least a portion of the wiring harness into a mold, and molding, together with the portion of the wire harness assembly, plastic material to create a flange of a fuel delivery module, the flange defining an inside region and an outside region, the terminal being accessible from the outside region of the flange, with an end of the wire being accessible from the inside region of the flange, wherein the molding step includes molding the plastic material directly over at least a portion of the terminal to encapsulate the portion of the terminal in the plastic material.

3. The method of claim 2, wherein step of molding plastic material includes molding plastic material over at least a portion of the body.

4. The method of claim 3, wherein step of molding plastic material includes ensuring that when certain forces are exerted on the harness assembly, the wires will break from the body or the body will separate from the flange with the terminals remaining encapsulated in the flange.

5. The method of claim 2, wherein the plastic is acetel resin.

6. The method of claim 2, wherein with the electrical connection is a crimp connection.

7. The method of claim 2, wherein the electrical connection is a solder connection.

8. The method of claim 2, wherein the electrical connection is a chemical connection.

9. The method of claim 2, wherein the providing step provides four terminals, with a connection joining a wire to an associated terminal.

10. The method of claim 9, wherein two terminals and associated wires are constructed and arranged to power a level sender and the other two terminal and associated wires are constructed and arranged to power a pump.

* * * * *